US009677399B2

(12) United States Patent
Modlinski et al.

(10) Patent No.: US 9,677,399 B2
(45) Date of Patent: Jun. 13, 2017

(54) YIELDABLE ROCK ANCHOR

(71) Applicant: MINOVA INTERNATIONAL LIMITED, South Yorkshire (GB)

(72) Inventors: Dariusz Modlinski, Olstyn (PL); Tadeusz Wosik, Czestochowa (PL); Martin Petranek, Praha 3-Zizkov (CZ)

(73) Assignee: Minova International Limited (GB)

( * ) Notice: Subject to any disclaimer, the term of this patent is extended or adjusted under 35 U.S.C. 154(b) by 0 days.

(21) Appl. No.: 14/904,445

(22) PCT Filed: Jul. 12, 2013

(86) PCT No.: PCT/EP2013/002080
§ 371 (c)(1),
(2) Date: Jan. 12, 2016

(87) PCT Pub. No.: WO2015/003726
PCT Pub. Date: Jan. 15, 2015

(65) Prior Publication Data

US 2016/0168993 A1 Jun. 16, 2016

(51) Int. Cl.
*E21D 21/00* (2006.01)

(52) U.S. Cl.
CPC ..... *E21D 21/0033* (2013.01); *E21D 21/0046* (2013.01)

(58) Field of Classification Search
CPC ..... E21D 21/0033; E21D 21/0046; E21D 21/006; F16B 31/021
USPC ..... 405/259.1, 259.2, 259.3
See application file for complete search history.

(56) References Cited

U.S. PATENT DOCUMENTS

| | | | | |
|---|---|---|---|---|
| 4,173,918 | A * | 11/1979 | Piersall | F16B 13/066 411/51 |
| 4,664,561 | A * | 5/1987 | Frease | E21D 20/025 405/259.3 |
| 5,584,608 | A * | 12/1996 | Gillespie | E21D 11/006 405/259.6 |
| 5,993,129 | A | 11/1999 | Sato | |
| 7,381,013 | B1 | 6/2008 | Rataj et al. | |
| 2004/0136789 | A1 | 7/2004 | Fergusson | |
| 2004/0184872 | A1 | 9/2004 | Papousek et al. | |

(Continued)

FOREIGN PATENT DOCUMENTS

| | | | |
|---|---|---|---|
| CA | 2480729 | A1 | 12/2005 |
| WO | WO 2007/059580 | A1 | 5/2007 |

(Continued)

*Primary Examiner* — John Kreck
*Assistant Examiner* — Carib Oquendo
(74) *Attorney, Agent, or Firm* — Baker & Hostetler LLP

(57) ABSTRACT

The invention relates to a yieldable rock anchor comprising an anchor element extending along a longitudinal center axis and having a first end, a second end and an outer surface. An anchor plate is attached near the first end of the anchor element, and an anchor head is secured to the first end of the anchor element and adapted to clampingly engage the anchor plate. On its outer surface, the anchor element is provided along at least substantially its entire length with a plurality of ribs. A plurality of sleeves, each sleeve having two opposing ends, for covering some of the plurality of ribs is fixedly arranged on the outer surface of the anchor element such that each of the opposing ends at least substantially sealingly engages the outer surface of the anchor element.

12 Claims, 1 Drawing Sheet

(56) References Cited

U.S. PATENT DOCUMENTS

| | | | | |
|---|---|---|---|---|
| 2007/0253783 | A1* | 11/2007 | Bureau | E21D 21/0046 405/259.3 |
| 2010/0202838 | A1* | 8/2010 | Weaver | E21D 21/0026 405/259.1 |
| 2012/0014756 | A1* | 1/2012 | Cai | E21D 21/0013 405/259.1 |
| 2015/0144394 | A1* | 5/2015 | Webb | H02G 1/14 174/658 |

FOREIGN PATENT DOCUMENTS

| | | | |
|---|---|---|---|
| WO | WO 2008/122086 | A1 | 10/2008 |
| WO | WO 2010/009506 | A1 | 1/2010 |
| WO | WO 2013/173901 | * | 11/2013 |

* cited by examiner

YIELDABLE ROCK ANCHOR

CROSS-REFERENCE TO RELATED APPLICATIONS

This application is the national Stage of International Application No. PCT/EP2013/002080, filed Jul. 12, 2013, the disclosure of which is incorporated herein by reference in its entirety.

STATEMENT REGARDING FEDERALLY SPONSORED RESEARCH OR DEVELOPMENT

Not applicable.

THE NAMES OF THE PARTIES TO A JOIN RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Rock anchors, also referred to as rock bolts, are widely used for example in mining and tunneling for rock reinforcement purposes, in particular to stabilize the wall of a gallery or tunnel. To this end, boreholes usually between two and twelve meters long are driven into a rock face. Rock bolts of corresponding length are then introduced into the boreholes and, depending on the type of rock bolt, are fastened in the borehole by means of grout, synthetic resin adhesives or mechanically, e.g. by clamping or bracing. Well known types of rock bolts are mechanical anchors, e.g. expansion shell anchors, resin rock bolts and so-called SN anchors. Some anchors, such as the SN anchors, are usually fully grouted, i.e. grouted along their entire length in the borehole. Other anchors are only fastened in an end region of the borehole, e.g. by means of resin adhesives or mechanical fastening. Self-drilling anchors, which do not require a predrilled borehole and which usually employ a hollow steel rod as anchor element, are also known. Sometimes, classifying a rock bolt as belonging to a certain type is impossible, as a large variety of rock bolts is known.

An anchor plate is normally mounted onto the end of the anchor element projecting from the borehole and is clamped by means of an anchor head against the rock face. In this way, loads acting in the region of a wall of a gallery or tunnel may be introduced into deeper rock strata. In other words, by employing rock anchors rock strata more remote from the wall may be used for load transmission in order to minimize the risk of collapse of a gallery, tunnel or other structure.

FIELD OF THE INVENTION

The present invention relates to rock anchors in general and in particular to yieldable rock anchors.

DESCRIPTION OF RELATED ART INCLUDING INFORMATION DISCLOSED UNDER 37 CFR 1.97 AND 1.98

Rock anchors must withstand both dynamic loads and static loads, such as squeezing ground and large displacements in rock strata. To better cope with in particular dynamic loads, so-called yieldable rock anchors have been developed, which, in the event of a predetermined load being exceeded, yield in a defined manner, i.e. are able to increase their length within specific limits in order to reduce stress acting in the rock to an amount that the rock anchor can reliably handle. Yieldable rock anchors tend to have a more complex structure and are, therefore, more expensive than non-yieldable rock anchors.

BRIEF SUMMARY OF THE INVENTION

It is an object of the present invention to provide an improved yieldable rock anchor which may handle a wide range of both static and dynamic loads, which may easily be tailored to specific requirements and which is easy to use and inexpensive to manufacture.

With a view to solving the above objects, the present invention provides a novel yieldable rock anchor comprising an anchor element extending along a longitudinal center axis and having a first end, a second end and an outer surface. The anchor element may e.g. be a solid anchor rod, a hollow anchor rod, a stranded wire, or a combination thereof. Accordingly, the anchor element may be rigid or may be flexible, at least in part. An anchor plate is attached near the first end of the anchor element, and an anchor head is secured to the first end of the anchor element and adapted to clampingly engage the anchor plate. On its outer surface, the anchor element is provided along at least substantially its entire length with a plurality of ribs. A plurality of sleeves, each sleeve having two opposing ends, for covering some of the plurality of ribs is fixedly arranged on the outer surface of the anchor element such that each of the opposing ends at least substantially sealingly engages the outer surface of the anchor element.

Each length interval covered by one of the plurality of sleeves defines a yieldable portion of the rock anchor, since the anchor element when covered by a sleeve is prevented from bonding to the borehole wall and may, therefore, yield under e.g. dynamic loads. In contrast, those portions of the anchor element which are not covered by the plurality of sleeves will bond to the borehole wall by means of the grout or resin used to fasten the rock anchor and will, therefore, provide a high load bearing capacity with regard to static loads. In other words, the present invention provides a rock anchor suited for a large variety of both static and dynamic loads by providing, on the anchor element, first zones for rigidly securing the anchor element to the borehole wall in order to offer a high static load bearing capacity, as well as second zones adapted to yield in a longitudinal direction, enabling the rock anchor to cope well with dynamic loads. Each sleeve acts a debonding element by preventing the covered outer surface of the anchor element from bonding, via the grout or resin, to the borehole wall.

The first and second zones may easily be distributed along the length of the anchor element as needed, by simply arranging the plurality of sleeves on the anchor element to form the second zones. Sleeves may be arranged on the outer surface of the anchor element distributed along just a portion or several portions of the anchor element or may be distributed along the entire length of the anchor element.

In order to assure that an anchor element portion which is covered by a sleeve will be able to yield if needed, it is necessary that each of the opposing ends of the sleeve at least substantially sealingly engages the outer surface of the anchor element to substantially prevent grout or resin from entering into the sleeve.

However, if some small amount of grout or resin penetrates into the end regions of a sleeve, this will not detrimentally affect the yielding ability provided that the outer surface of the anchor element covered by the sleeve is predominately free from grout or resin.

Yieldable rock anchors according to the present invention are cost-efficient to manufacture, as e.g. serrated steel rods, so-called rebars, which are commonly employed in concrete reinforcement, may be used as anchor elements. Also, the sleeves used for forming the second zones, i.e. the yieldable zones, are cheap to manufacture from e.g. regular steel tubing and may easily be fixed to the outer surface of the anchor element at the desired position by e.g. crimping the two opposing ends of each sleeve. Yieldable rock anchors of the present invention are easily tailored to needs by selecting the length and diameter of the anchor element, the material of the anchor element as well as the material, position and number of the sleeves according to given requirements.

The plurality of ribs on the outer surface of the anchor element may be continuous ribs, broken ribs, staggered ribs or any combination thereof. The ribs may extend at substantially right angle to the longitudinal center axis of the anchor element, but may also run obliquely with regard to the longitudinal center axis. Also, the ribs may form a thread or not. If the anchor element is a stranded wire, the strands of the wire may form the ribs.

Each of the plurality of sleeves may have a smooth outer surface to facilitate insertion of the rock anchor into the borehole as well as to facilitate flow of grout or resin past the sleeves.

Each of the plurality of sleeves may be a single-piece member or a multi-piece member, in particular a two-piece member. If a sleeve is configured as a multi-piece member, precautions have to be taken to appropriately seal each sleeve against ingress of grout or resin.

The material forming each sleeve may be selected from a wide range of materials, but will usually be steel. With some preferred embodiments, the material selected for forming the sleeves will have the same or a lower tensile strength than the tensile strength of the anchor element material. In more general terms, the anchor element should normally be the load bearing element of the rock anchor, such that the sleeves will preferably yield simultaneously with the anchor element. However, in applications where large rock movements are to be expected, resulting in corresponding high shear stress on installed rock anchors, it can be advantageous to use the sleeves as additional load bearing elements, by designing them with thicker sleeve walls and/or by making them from a high tensile strength material in order to improve their ability to withstand shear forces resulting from rock movements.

Accordingly, the sleeve material may also have a higher tensile strength than the anchor element. The anchor element material will also usually be steel, but other materials are conceivable. It is also possible, and may be economical, for the material forming the plurality of sleeves to be the same material used for forming the anchor element. Usually, the inner surface of the sleeves, except for the end portions of the sleeves, will not contact the outer surface of the anchor element, in order to prevent the sleeves from obstructing a yielding action. However, it is possible for the inner surface of the sleeves to contact the outer surface of the anchor element if it is desired that the sleeves serve as additional load bearing elements or if the sleeve is designed such that it yields earlier than the anchor element or at least simultaneously with the anchor element.

It was pointed out before that each of the plurality of sleeves serves to cover a length interval of the outer surface of the anchor element. In preferred embodiments of the present invention, uncovered length intervals between successive sleeves are bigger than covered length intervals. It should be clear, however, that preferences may vary in accordance with specific requirements.

In preferred embodiments of the present invention, the plurality of sleeves may cover between 10% and 50% of the total length of the anchor element. Moreover, the plurality of sleeves may be distributed evenly along the length of the anchor element, or may be positioned in groups or otherwise, as desired.

To provide effective sealing, a separate sealing element may be disposed at each of the two opposing ends of each sleeve between the sleeve and the outer surface of the anchor element. Preferably, each separate sealing element is an elastomeric sealing element, such as an O-ring seal. More than one sealing element may be employed at each sleeve end, if desired.

In some embodiments of the present invention, the anchor head is formed integrally with the anchor element, e.g. by forging. Regardless of whether the anchor head is formed integrally with the anchor element or not, the anchor head may take the form of a domed anchor nut. Alternatively, the anchor head may be a hex nut cooperating, if desired, with a domed washer. If the anchor head is not formed integrally with the anchor element, it may take the form of a nut in mating engagement with a threaded portion on the anchor element, the threaded portion being provided at the end of the anchor element projecting from the borehole. A shear pin may extend through the threaded portion and the nut at right angle to the longitudinal center axis of the anchor element.

Generally, the anchor head is provided for cooperation with a mounting adapter used to set the rock anchor into the borehole, and for tightening the rock anchor once the resin has set. In the variant having a shear pin extending through the threaded portion and the nut, the nut is prevented form rotating relative to the anchor element during a first stage of installing the rock anchor. Resin capsules are inserted into the borehole, and the rock anchor is then introduced into the borehole and rotated to destroy the capsules and mix the resin components. Rotation of the rock anchor via the nut serving as anchor head is possible, since the nut is blocked against relative rotation by the shear pin. Once the resin has cured, which may take only a few seconds or so, the torque applied to the anchor head is increased, resulting in the shear pin braking and allowing relative rotation of the nut to tighten the nut until the anchor plate firmly abuts the rock face.

BRIEF DESCRIPTION OF THE SEVERAL VIEWS OF THE DRAWINGS

Currently preferred embodiments of a yieldable rock anchor according to the present invention will now be described in more detail with reference to the accompanying schematic figures.

DETAILED DESCRIPTION OF THE INVENTION

Figure 1:
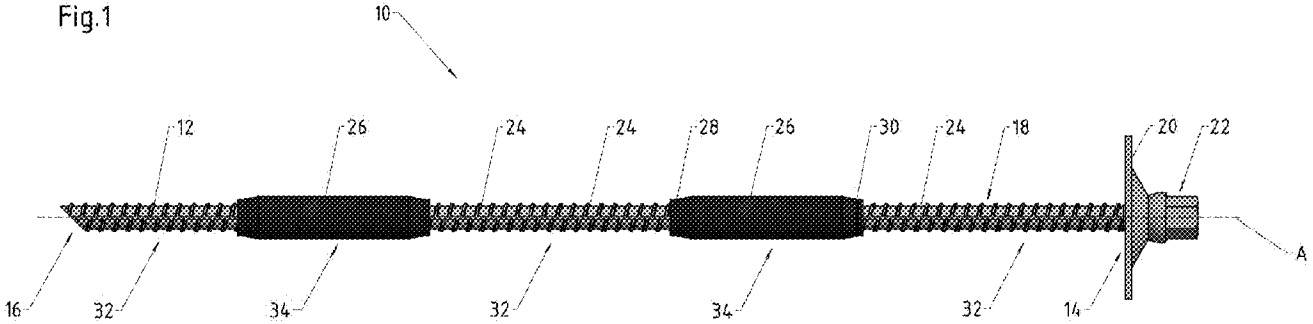
FIG. 1 shows a side view of a first embodiment of a yieldable rock anchor according to the present invention.
Figure 2:
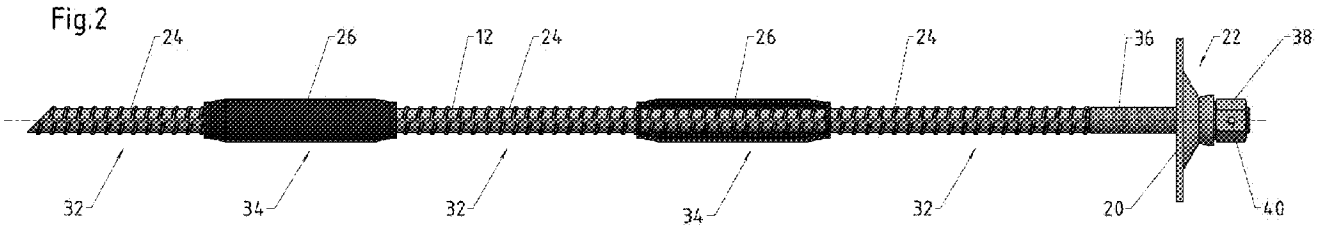
FIG. 2 shows a partially broken away side view of a second embodiment of a yieldable rock anchor according to the present invention.
Figure 3:
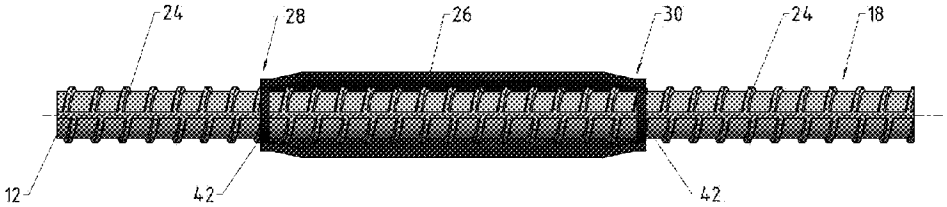
FIG. 3 is an enlarged portion of FIG. 2, showing a sleeve fixedly arranged on an outer surface of an anchor element in more detail.

FIG. 1 shows a side view of a first embodiment of a yieldable rock anchor, or rock bolt, generally designated at 10. The rock bolt 10 includes an anchor element 12 having a first end 14, a second end 16 and an outer circumferential surface 18. The second end 16 may have an oblique cut, as shown, or may be a blunt end. In the embodiment of FIGS. 1 to 3, the anchor element 12 is in the form of a solid steel rod.

An anchor plate 20, taking the form of a dished plate in the embodiment shown, is received on the anchor rod 12 near its first end 14. An anchor head 22 secured to the first end 14 of the anchor rod 12 is adapted to clampingly engage the anchor plate 20 and in the present embodiment takes the form of a domed anchor nut having a hexagonal portion at its free end. The rock bolt 10 shown in FIG. 1 is of the forged head type, which means that the anchor head 22 is formed integrally with the anchor rod 12 by forging.

On its outer surface 18 the anchor rod 12 is provided along its entire length with a plurality of ribs 24 formed integrally with the anchor rod 12. A plurality of hollow cylindrical sleeves 26, two of which are shown in FIG. 1, cover certain portions or length intervals of the outer surface of the anchor rod 12. Each sleeve 26 has two opposing ends 28, 30 and is fixedly arranged on the outer surface of the anchor rod 12 by pressing the opposing ends 28, 30 against the outer surface 18 of the anchor rod 12, e.g. using a crimping process, whereby each of the opposing ends 28, 30 at least substantially sealingly engages the outer surface 18 of the anchor rod 12. "At least substantially sealingly engages" in the context of the present invention means that the opposing ends 28, 30 of each sleeve 26 need not form a waterproof sealing between the sleeve 26 and the outer surface 18 of the anchor rod 12, but will form a sealing which substantially prevents grout or resin to enter into a sleeve 26.

In the embodiment as shown, the anchor rod 12, the anchor plate 20, the anchor head 22 and the sleeves 26 are all made of steel. Further as shown, the sleeves 26 have a smooth outer surface, but may have a non-smooth surface in alternative embodiments not shown.

The hexagonal end portion of the anchor head 22 is able to cooperate with a mounting adapter (not shown) used to set the rock bolt 10 into a borehole (not shown).

The anchor rod 12 may for example have a diameter in the range of 12 to 40 mm, and may have a length in the range of 1.5 to 10 m, with 3 to 4 m being a typical length. The sleeves 26 may for example be 10 to 100 cm long, and a rock bolt 10 having a typical length of 4 m may be provided with four sleeves 26 each having a length of 10 to 30 cm.

Each sleeve 26 when mounted onto the anchor rod 12 serves to cover a length interval or zone of the outer surface 18 of the anchor rod 12 such that all ribs 24 on that length interval are masked or concealed. Therefore, by mounting the sleeves 26 onto the anchor rod 12, first zones or first length intervals 32 are defined which are not covered by the sleeves 26, and second zones or second length intervals 34 are defined, where the sleeves 26 mask the ribs 24.

As is well-known to skilled persons in the field to which the present invention pertains, grout or resin is used to fasten a rock bolt in a borehole. The first zones 32 of the rock bolt 10 will bond to the borehole wall by means of the grout or resin present in the borehole and will thus form zones which provide a high static load bearing capability.

In the second zones 34, however, only the sleeve 26 will bond to the borehole wall, whereas the outer surface 18 of the anchor rod 12, in each second zone 34, will be kept free or at least substantially free from grout or resin, thus retaining the capability to yield under e.g. dynamic loads. As shown (cf. FIG. 3), an inner surface of each sleeve 26 does not contact the outer surface 18 of the anchor rod 12 except for the opposing end portions 28, 30. The sleeves 26 as shown are single-piece members, but may consist of two or more parts in embodiments not shown.

FIG. 2 shows a schematic side view of a second embodiment, which is similar to the first embodiment except for the anchor head 22. In the second embodiment, the anchor rod 12 is provided on its outer surface 18 with a thread 36 in an end portion including the first end 14. A domed anchor nut 38 matingly engages the thread 36 and is provided with a shear pin 40 extending transversally through a hexagonal portion of the anchor nut 38 and the anchor rod 12. Shear pin 40 blocks anchor nut 38 against rotation relative to anchor rod 12 when installing rock bolt 10 into a borehole. Once the grout or resin used for fastening the rock bolt 10 in the borehole has fully cured, a torque applied to the anchor nut 38 may be increased until the shear pin 40 breaks, thus allowing to tighten the anchor nut 38 and anchor plate 20 against a rock face.

FIG. 3 shows an enlarged view of a sleeve 26 mounted onto the anchor rod 12. As shown, ring-shaped sealing elements 42 may be used to further enhance a sealing action between the opposing ends 28, 30 of sleeve 26 and the outer surface 18 of anchor rod 12. In the embodiment as shown, the sealing elements 42 are elastomeric O-ring seals.

Typical embodiments of rock bolts 10 of the present invention will have more than just two sleeves 26. By suitably selecting the position and length of the sleeves 26, the rock bolt 10 can easily be tailored to provide yielding and non-yielding characteristics, as desired for a given application.

The invention claimed is:

1. A yieldable rock anchor, comprising:

an anchor element extending along a longitudinal center axis and having a first end, a second end and an outer surface, an anchor plate attached near the first end of the anchor element, and an anchor head secured to the first end of the anchor element and adapted to clampingly engage the anchor plate, wherein the anchor element is provided, on its outer surface with a plurality of ribs, and wherein one or more sleeves for covering some of the plurality of ribs, with each sleeve having two opposing ends and being fixedly arranged on the outer surface of the anchor element such that each of the opposing ends at least substantially sealingly engages the outer surface of the anchor element, while an inner surface of each sleeve is spaced apart from the outer surface of the anchor element except at the opposing ends of each sleeve.

2. The yieldable rock anchor according to claim 1, wherein each sleeve is one of a single-piece member and a multi-piece member.

3. The yieldable rock anchor according to one of claim 1, wherein each sleeve is formed from a material selected from the group of materials having a same tensile strength or a lower tensile strength than a tensile strength of the anchor element.

4. The yieldable rock anchor according to claim 3, wherein the material forming each sleeve and the material forming the anchor element is the same material.

5. The yieldable rock anchor according to claim 1, wherein each sleeve covers a length interval of the outer surface of the anchor element, and wherein uncovered length intervals between adjacent sleeves are bigger than covered length intervals.

6. The yieldable rock anchor according to claim 1, wherein the sleeves cover between 10% and 50% total length of the anchor element.

7. The yieldable rock anchor according to claim 1, wherein a separate sealing element is disposed at each of the two opposing ends of each sleeve between the sleeve and the outer surface of the anchor element.

8. The yieldable rock anchor according to claim 7, wherein the separate sealing element is an elastomeric sealing element.

9. The yieldable rock anchor according to claim 1, wherein the anchor head is formed integrally with the anchor element.

10. The yieldable rock anchor according to claim 1, wherein the anchor head is a nut in mating engagement with a threaded portion on the anchor element, and wherein a shear pin extends through the threaded portion and the nut at right angle to the longitudinal center axis.

11. The yieldable rock anchor according to claim 1, wherein the plurality of ribs on the outer surface of the anchor element are one of continuous ribs, broken ribs and staggered ribs.

12. The yieldable rock anchor according to claim 1, wherein the anchor element is at least one of a solid rod, a hollow rod and a stranded wire.

* * * * *